United States Patent [19]

Parracho et al.

[11] Patent Number: 4,731,939

[45] Date of Patent: Mar. 22, 1988

[54] ATHLETIC SHOE WITH EXTERNAL COUNTER AND CUSHION ASSEMBLY

[75] Inventors: Rui M. Parracho, Peabody; Lloyd S. Smith, Newton Center; Richard P. Bunch, Reading; Alexander L. Gross, Boston, all of Mass.

[73] Assignee: Converse Inc., North Reading, Mass.

[21] Appl. No.: 6,723

[22] Filed: Jan. 23, 1987

Related U.S. Application Data

[62] Division of Ser. No. 726,508, Apr. 24, 1985, Pat. No. 4,638,576.

[51] Int. Cl.[4] ..... A43B 13/12; A43B 13/18

[52] U.S. Cl. ..... 36/31; 36/30 R; 36/28

[58] Field of Search ..... 36/30 R, 36, 25 R, 28, 36/32 R, 114, 129, 102, 103

[56] References Cited

U.S. PATENT DOCUMENTS

| | | | |
|---|---|---|---|
| 4,043,058 | 8/1977 | Hollister et al. | 36/28 |
| 4,128,950 | 12/1978 | Bowerman et al. | 36/28 |
| 4,302,892 | 12/1981 | Adamik | 36/31 |
| 4,364,188 | 12/1982 | Turner et al. | 36/30 R |
| 4,398,357 | 8/1983 | Batra | 36/31 |
| 4,481,727 | 11/1984 | Stubblefield | 36/30 R |
| 4,490,928 | 1/1985 | Kawashima | 36/30 R |
| 4,506,462 | 3/1985 | Cavanagh | 36/30 R |
| 4,561,140 | 12/1985 | Graham et al. | 36/30 R |
| 4,638,576 | 1/1987 | Parracho et al. | 36/68 |

*Primary Examiner*—Henry S. Jaudon
*Assistant Examiner*—Steven N. Meyers
*Attorney, Agent, or Firm*—Bromberg, Sunstein & Casselman

[57] ABSTRACT

In an athletic shoe, an external counter and cushion assembly includes a substantially rigid external counter extending medially to approximately the front flex line, and a rearfoot cushion member is mounted within the rigid counter. This assembly mounts externally to the heel and counter region of a lasted upper. The floor of the cushion member also extends forwardly toward the front-flex region of the shoe and is preferably wedge-shaped to serve as a heel-lift layer. The cushion walls are generally coextensive with the counter walls, insulating the upper from the rigid counter in this region. The external counter construction includes a base flange which mounts atop the midsole periphery on a plane substantially below the bottom surface of the foot.

1 Claim, 9 Drawing Figures

ATHLETIC SHOE WITH EXTERNAL COUNTER AND CUSHION ASSEMBLY

This is a divisional application from Ser. No. 726,508, filed Apr. 24, 1985, U.S. Pat. No. 4,638,576.

TECHNICAL FIELD

The present invention relates to athletic shoes, and more particularly to counter assemblies for running shoes.

BACKGROUND ART

Over the last several years, as the foot-strike patterns of running and walking have been better understood, many running shoe features have been developed for providing increased foot control in order to prevent injury, and maximize comfort. These developments have tended to focus on the medial, plantar arch region of the foot and sole, into which the ankle bends during pronation, as well as on the ankle-heel region, which first receives the loads of foot strike. Such devices have included, for instance, medially inclined and dual density midsoles, resilient midsole pegs, hard rubber heel tabs for inhibiting compression of the midsole in selected areas, rigid, embedded heel skirts and flared, upturned outsoles. On the shoe upper, counters have been extended forwardly on the medial side of the shoe, and have been tried in various materials to achieve the competing goals of support and flexibility.

DISCLOSURE OF THE INVENTION

The present invention provides a novel external counter-and-cushion assembly in a running shoe, in which a counter-shaped cushion member includes a floor portion that serves as a heel-lift layer, and is mounted intermediate a rigid external counter and a lasted athletic shoe upper. The substantially rigid external counter member has a perimeter flange for mounting on the upper surface of the midsole, as well as a wall portion that includes a medial side wall extending from the heel to approximately just behind the first metatarsal joint. The cushion member has a floor portion as described above that extends across the full width of the shoe in the heel area, and forwardly to about the front flex line of the shoe, and in a preferred embodiment is built up along its medial edge. The cushion side wall portion lies adjacent to, and is generally coextensive with, the medial side wall of the counter, and is intended in other embodiments to be made coextensive with the lateral counter wall as well. This entire counter and cushion assembly is then mounted externally to a lasted upper, preferably slip-lasted.

As is standard in running shoes, the sole comprises an outsole and a midsole. In a preferred embodiment the midsole has regions of a first, greater compressibility (spongier) and of a second, lesser compressibility (harder). The harder region underlies at least the flange portion of the counter, so as to provide a firm support therefor. In a further preferred embodiment, the outsole has an aperture therethrough centered along the central axis of the foot and extending from the heel area to approximately the front flex line of the foot. The spongier midsole portions include a portion overlying the aperture of the outsole. Thus the softer midsole material in that region may compress without restraint by the outsole, providing increased cushioning in this non-load bearing area of the shoe. Advantageously a softer midsole region is further located in the region of the front flex line of the foot, extending transversely from one side of the shoe to the other just behind the toe line. In a further preferred embodiment the outsole also comprises regions of differing hardness, i.e., a region of first hardness and a second region of greater hardness, with the second region including a portion underlying the medial side of the counter flange. In this manner, a novel structure is provided that confers sufficient rigidity to maintain adequate foot alignment during all phases of running while still maximizing the cushioning effect of the structures above and below the counter flange.

BRIEF DESCRIPTION OF THE DRAWINGS

These and other features of the invention will be more clearly understood by reference to the drawings, in which.

DESCRIPTION OF THE INVENTION

Figure 1:
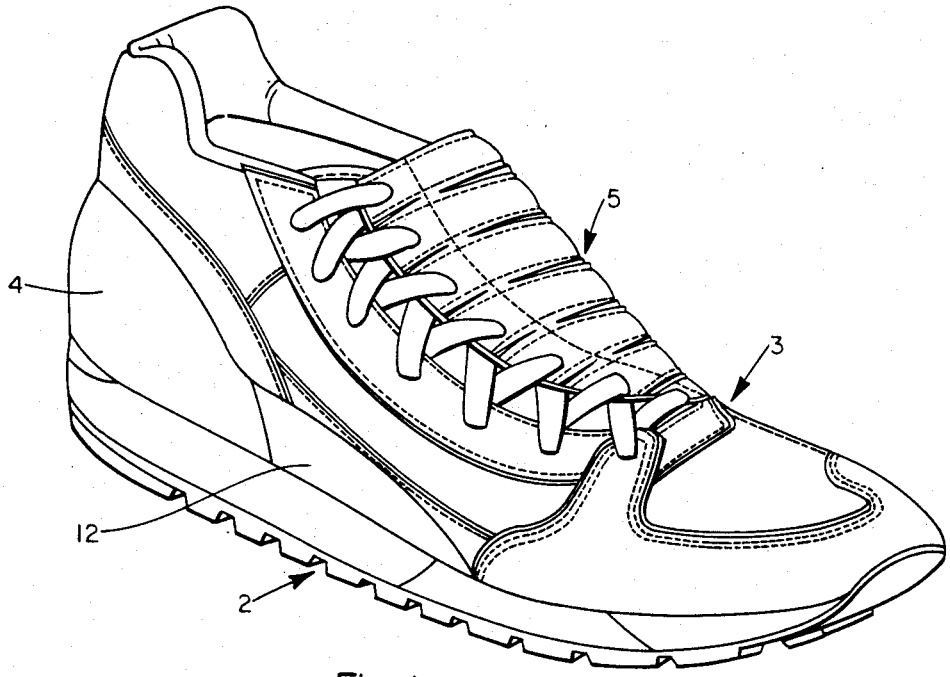
FIG. 1 shows a lateral front perspective view of one embodiment of a shoe according to the present invention.

FIG. 1 shows a lateral perspective view of a shoe 1 embodying the present invention. Shoe 1 has a sole 2 and an upper 3. Upper 3, as shown comprises portions which may be fabric, and other portions preferably of leather which serve as reinforcements or structural bands in the stress bearing or wear resisting parts of the shoe, so as to encase the foot of the wearer in a manner well known in the art. Also shown is a counter 4, and the lateral side edge 12 of the floor of the cushion member (shown fully in FIGS. 8 and 9 and designated by its components 12 and 13) between upper 3 and the midsole.

The upper of FIG. 1 depicts a lateral lacing system employing a band structure 5 which appears in a preferred embodiment of the shoe. This lacing system is the subject of a co-pending application by a different inventive entity, and forms no part of the present invention. Thus, for instance, a conventional upper is also suitable for use with the present shoe.

Figure 2:
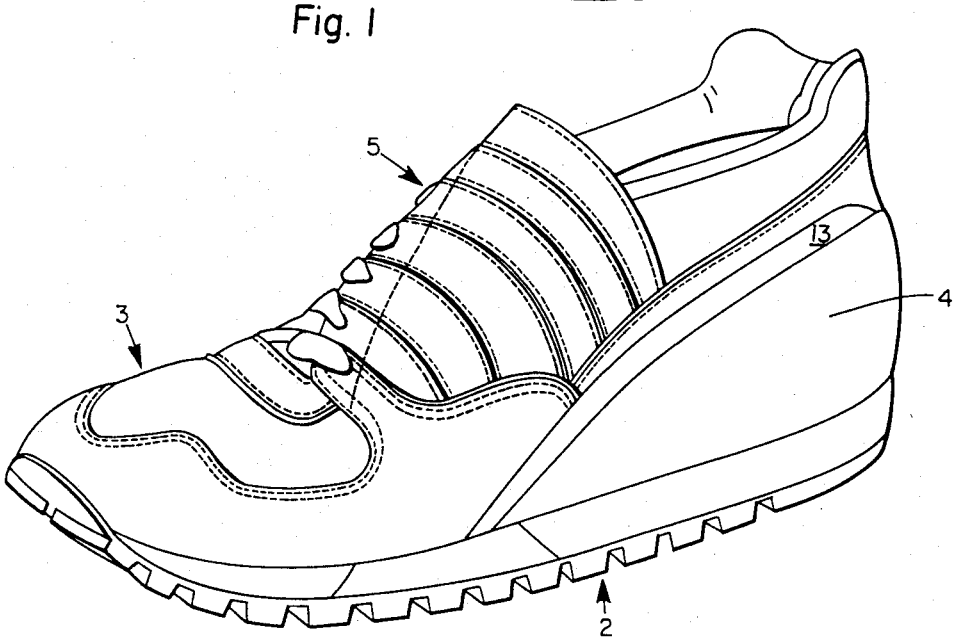
FIG. 2 shows a medial front perspective view of the shoe of FIG. 1.
Figure 3:
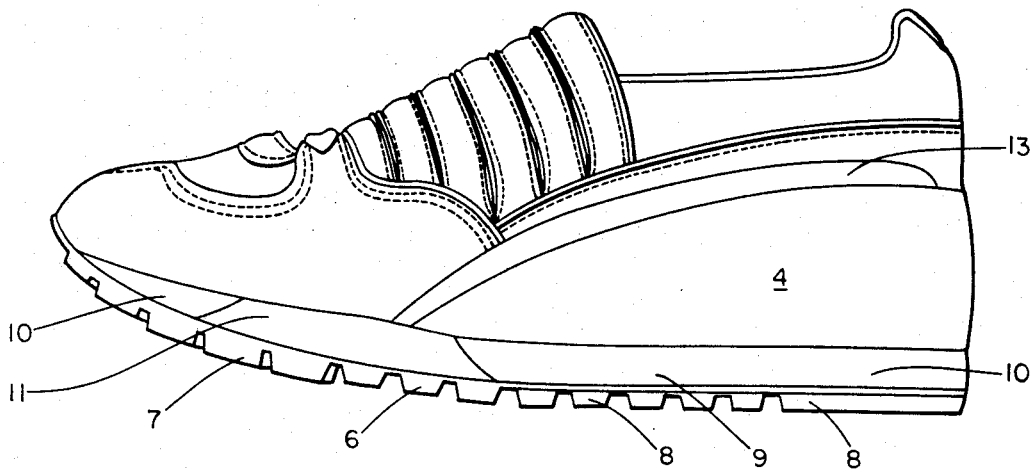
FIG. 3 shows a medial side view of the shoe of FIG. 1.

FIG. 2 shows another view of the shoe 1 of FIG. 1, showing the sole 2, upper 3, counter 4 and band structure 5 viewed from a medial side perspective. Also visible above counter 4 is the upper edge of medial side wall 13 of the cushion member 12, 13 of FIGS. 8 and 9. As shown, counter 4 extends further forward on the medial side than on the lateral side, to approximately the front flex line of the foot. FIG. 3 shows a medial side view of the preferred embodiment of the shoe picturing an outsole, shown generally as 6, having a front region 7 and a rear region 8. On top of the outsole is a midsole layer 9, of substantially uniform thickness and extending the full length of the shoe. As shown, midsole layer 9 has regions 10, 11 of differing compressibilities, as will be discussed further in relation to FIG. 6. On top of midsole layer 9 is seen counter 4, a substantially rigid member, formed with a flange around its base of a type known in the art for mounting on midsole 9. Preferably counter 4 is formed of a strong but lightweight material, e.g., a graphite fiber material or similar material such as that marketed under the tradename HYTREL. A PVC may also be used. Set within counter 4 is cushion member 12, 13 of which the upper edge of medial side wall 13 is visible.

In the embodiment shown, the upper is slip-lasted, and the exterior surface thereof is bonded to the midsole 9, cushion member 12, 13 and to rear and lateral side portions of counter 4. In the forward area the upper 3 is bonded directly to the midsole 9. On the medial side of the shoe upper 3 is bonded to the cushion side wall 13 of the cushion member; at the very rear of the shoe the upper is bonded directly to the counter member. Further details of this attachment will be clear with reference to FIG. 4.

In other preferred embodiments, the upper bonds only to cushion member 12, 13 in the mid and rearfoot area, due to the mating contours of the cushion member of such an embodiment in the rear and lateral counter region, so as to fully insulate the surface of the upper from the rigid counter walls.

Figure 4:
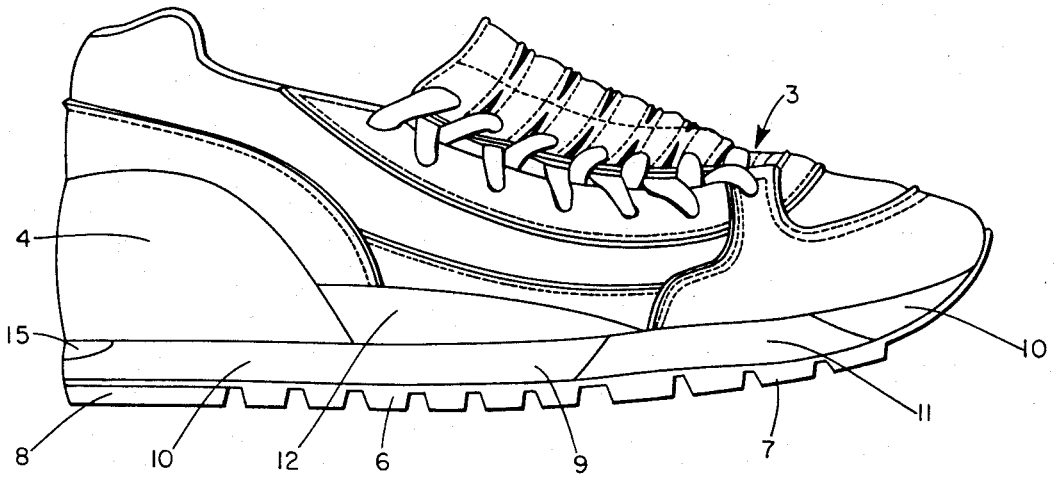
FIG. 4 shows a lateral side view of the shoe of FIG. 1.

FIG. 4 shows a lateral side view of the shoe of FIG. 1. As shown, the shoe includes an outsole portion 6, a midsole portion 9, counter 4, cushion floor portion 14 and upper 3. Midsole has a region of lesser density (or greater compressibility) in the front flex area thereof, visible at 11. Also visible is a small region 15 of lesser density at the rear heel region of the shoe. On the lateral side, counter member 4 has a forward dimension approximating that of a conventional counter member. That is, it provides a firm wall approximately surrounding the calcaneus of the foot. As noted above counter 4 has a bottom flange for mounting to midsole 9. Unlike a conventional counter however, the counter walls mount first to a cushion member and then the entire assembly to the lasted upper, such that the counter flange rests on midsole layer 9 along a plane substantially below the bottom of the user's foot. Floor portion 12 of cushion member 12, 13 is shown extending forwardly to the front flex region of the foot so as to form a structure similar to a conventional midsole wedge, or "heel-lift layer," for elevating the heel above the toe. Unlike a conventional midsole wedge however, the floor portion 12 is mounted on top of the mounting flange of counter 4 and is thus constrained along its side edges by the walls of the counter as well as being inhibited in its downward motion along its perimeter by the counter flange. The external counter and cushion member thus provide a trampoline-like frame and sheet, respectively, for resiliently cradling the heel. In a preferred embodiment, cushion member 12, 13 is made of a urethane foam of approximately 50 durometer on an Asker type C hardness scale, and is preferably posted so that the medial side thereof is approximately ⅛" thicker along its full length than the lateral side, so as to counteract the ankle's tendency to pronate into that arched region.

Figure 5:
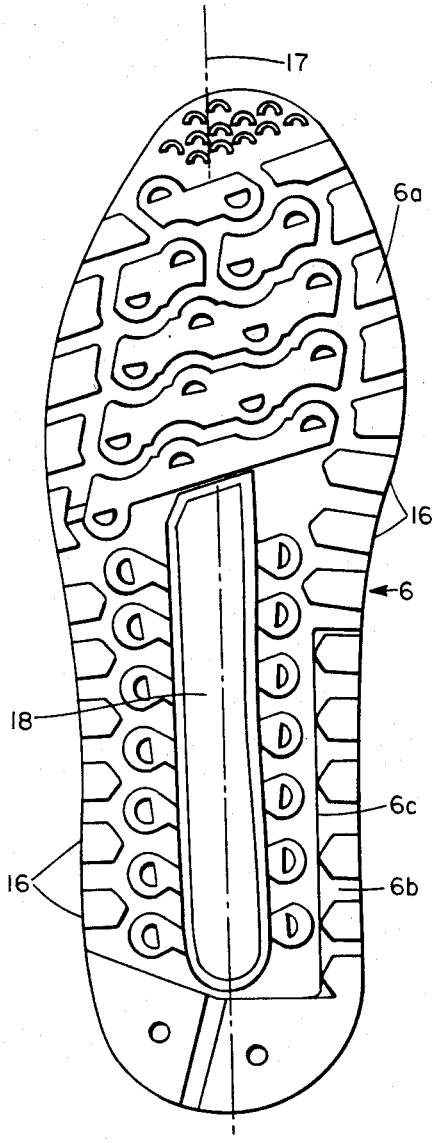
FIG. 5 shows a bottom view of the shoe of FIG. 1.

Turning now to FIG. 5, there is shown a bottom view of the outsole 6 of the shoe of FIG. 1. As shown, outsole 6 has a number of peripheral traction elements 16 spaced around the heel and midfoot regions. While the traction element design is roughly symmetrical about a longitudinal axis 17, the outsole of the preferred embodiment is composed of two regions of different materials having differing compressibilities. In the embodiment shown, a first region 6A is made of a hard, but still relatively compressible material, such as a blown rubber of the type sold under the trademark VIBRAM. The second region 6B having an edge 6C is of a stiffer, less compressible material, and includes a heel plate to resist wear upon initial foot strike, as well as a narrow peripheral band extending from the heel region toward the front of the shoe on the medial side. This second region of lesser compressibility serves as a firm pedestal to support the midsole and the medial counter flange directly above it.

Also shown in FIG. 5 is a central aperture 18 extending through the outsole from approximately the center of the heel region to a point just behind the front flex line of the foot, and approximately centered along the central longitudinal axis 17 of the shoe. Visible through cut-out 18 is the foam material of the overlying midsole 9. The peripheral cleats 16 preferably elevate the main plane of the outsole above the plane of the ground surface. Thus, when the weight of the foot bears down upon the overlying cushion and midsole layers, these layers flex downwardly without abruptly bottoming out on a hard outsole layer or on the ground.

Figure 6:
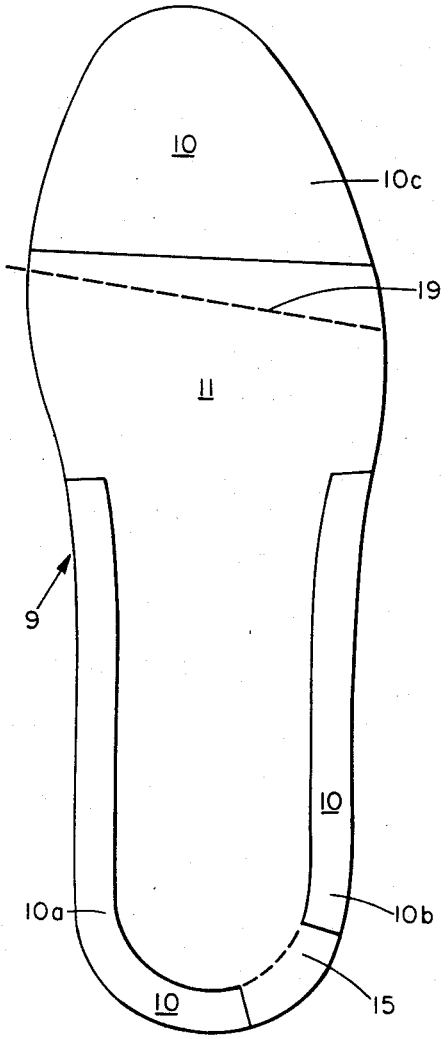
FIG. 6 shows a top view of the midsole layer of the shoe of FIG. 1.

Turning now to FIG. 6, there is shown a top view of the midsole 9 of the shoe of FIG. 1. As shown, midsole 9 comprises a sheet of foam which extends substantially the entire length from the rear of the heel to the front of the toe portion of the shoe, being tapered slightly at the toe to accommodate an upwardly curving portion of the outsole which is fastened to the upper in a manner known in the art.

Midsole 9 is preferably a microcellular foam such as that sold under the trade name GENOLON. As shown, midsole 9 comprises regions 10 and 11 of differing densities. Region 11, which is preferably a relatively soft foam having a hardness approximately in the range of 50–55 on the Asker C hardness scale, includes an area generally surrounding the front flex line of the midsole, and preferably also extends along the central portion of the sole back toward the heel. A small lip 15 of this material also extends entirely back to the rear of the heel on the lateral side of the foot. Region 10 is of a stiffer foam material, having a hardness of approximately 70 on the Asker C scale. As shown, the stiffer foamed region 10 includes regions 10*a* and 10*b* defining a narrow horseshoe-shaped perimeter around the mid and heel portions of the foot. Regions 10*a* and 10*b* alternatively may connect at 15. This stiff perimeter serves both to support the rigid counter member 4, and also to provide a general frame around the softer structure of the midsole. This stiffening perimeter provides a sole structure of sufficient rigidity so that the shoe may incorporate a slip-lasted rather than a board-lasted upper. A second region 10*c* of this stiffer foam is located ahead of the front flex line of the foot, and provides a protective rigidity to the toe portion of the shoe.

Collectively the rigid counter member 4 and the stiff horseshoe shaped midfoot and heel portions of the midsole provide a structural frame for the shoe to maintain the foot in proper alignment during and after heel strike. This supporting structure is isolated from the forefoot region of the shoe by the softer midsole portion 11 extending entirely across the flex line of the foot.

Figure 7:
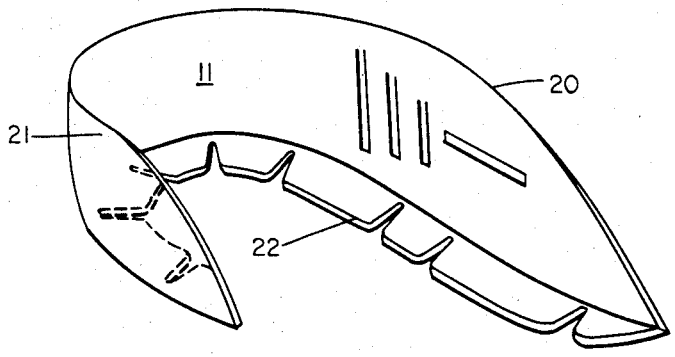
FIG. 7 shows a perspective view of the external counter member of the shoe.

Turning now to FIG. 7, there is shown a perspective view of the counter member 4 of the present invention. As shown, counter 4 comprises a medial side wall 20 and a lateral side wall 21. A flange 22 perpendicular to the walls of the counter is scored or perforated to aid in mounting on the midsole. Medial and lateral walls of the counter are each approximately 5 centimeters in height, considerably higher than a conventional internally mounted counter reinforcement, so as to mount on the surface of the midsole much lower than a conventional counter and to accommodate the cushion member 12 therein.

Figure 8:
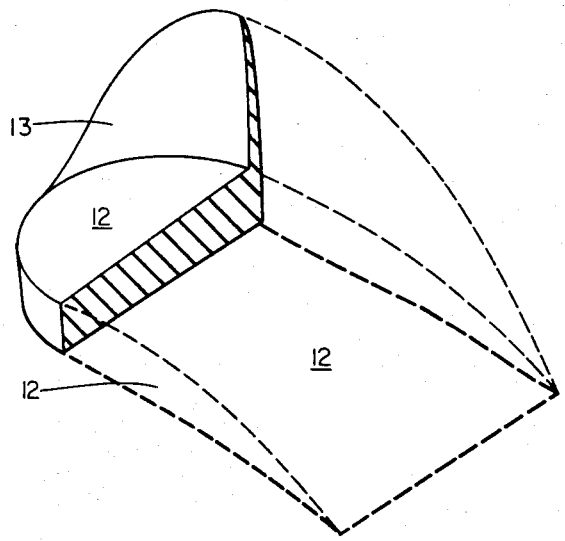
FIG. 8 shows a perspective view of one embodiment of the cushion member of the shoe of FIG. 1.
Figure 9:
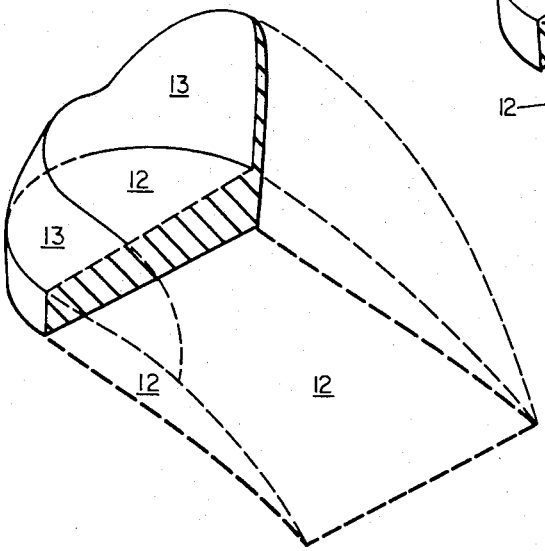
FIG. 9 shows a perspective view of a further embodiment of the cushion member of FIG. 8.

Turning to FIG. 8, there is shown a perspective view from the lateral side of one embodiment the cushion member 12. As shown, the rearfoot cushion member comprises floor 12 and a vertical side wall 13. The top edge of medial wall 13 is located at a height approximately 0.5 centimeters above that of the medial wall of the counter, so as to form a cushioning lip thereat, and is otherwise substantially of the same shape as the adjacent counter wall 20. As shown, the cushion medial side wall 13 extends from a point just ahead of the heel forwardly along the medial side to a point just before the front flex line. In this manner it provides cushioning support along the entire medial side and the inner surface of the arch of the foot so as to prevent excessive lateral motion during running. Floor portion 12 is wedge-shaped, tapering downward toward the midsole 9 at a point just before the front flex line of the foot, from a thickness of approximately 2 centimeters in the heel area. Preferably floor portion 12 is also posted from its lateral to medial sides, and is 3 to 4 millimeters thicker on the medial side so as to provide increased cushioning in the region of greater impact. The floor member is made up of a urethane of approximately 50 durometers. FIG. 9 pictures a further preferred embodiment of this cushion, wherein rear and lateral walls are added to fully insulate the walls of the rigid counter from the surface of the upper in these areas.

It will be appreciated that the foregoing structure provides a unique construction for stabilizing the foot within the same general plane in a manner that controls pronation during running, while retaining the comfort of a thick cushioned midsole and wedge construction. Furthermore, by using an apertured outsole and the skeletal structures provided by the counter member and stiff midsole horseshoe portion, a shoe structure is provided which is sufficiently rigid to provide control and support during motion, without sacrificing the shoe's ability to flex and twist.

Although specific embodiments of the invention have been described, numerous modifications may be made to the disclosed embodiments without departing from the spirit and scope of the invention.

What is claimed is:

1. An athletic shoe comprising:

an upper;

a midsole, including a low density central region and a higher density, substantially horseshoe-shaped perimeter around the middle and heel portions of the sole providing a frame around the central region and being interrupted in the lateral heel portion thereof by an indentation of the low density central region which extends therethrough to the periphery of the heel;

an outsole attached to the upper and the midsole, the outsole including a central longitudinal axis and defining a central aperture extending through the outsole from approximately the center of the heel region to a point just behind the front flex line of the foot and approximately centered along the central longitudinal axis such that the overlying midsole is visible through the aperture, the outsole further including peripheral cleats that elevate the main plane of the outsole above the plane of the ground surface.

* * * * *